United States Patent [19]

Loosli

[11] 4,337,706

[45] Jul. 6, 1982

[54] RAILWAY LOCOMOTIVE

[75] Inventor: Hugo Loosli, Winterthur, Switzerland

[73] Assignee: Schweizerische Lokomotiv und Maschinenfabrik, Winterthur, Switzerland

[21] Appl. No.: 215,760

[22] Filed: Dec. 12, 1980

Related U.S. Application Data

[63] Continuation of Ser. No. 964,379, Nov. 28, 1978, abandoned.

[30] Foreign Application Priority Data

Nov. 30, 1977 [CH] Switzerland ..... 14637/77

[51] Int. Cl.[3] ..... B61C 15/14; B61F 3/04; B61F 5/18; B61F 5/22

[52] U.S. Cl. ..... 105/184; 105/61; 105/136; 105/199 F; 105/199 R; 105/453

[58] Field of Search ..... 105/164, 182 R, 199 R, 105/210, 453, 61, 136, 184, 199 F

[56] References Cited

U.S. PATENT DOCUMENTS

| | | | |
|---|---|---|---|
| 1,084,653 | 1/1914 | McNulty | 105/453 |
| 3,734,030 | 5/1973 | Kreissig et al. | 105/164 |
| 3,756,161 | 9/1973 | Loosli | 105/199 R X |
| 3,828,692 | 8/1974 | Kreissig | 105/199 F |
| 3,896,740 | 7/1975 | Kreissig | 105/164 |
| 3,908,559 | 9/1975 | Fromm | 105/182 R X |

*Primary Examiner*—Joseph F. Peters, Jr.
*Assistant Examiner*—Howard Beltran

[57] ABSTRACT

The devices for transmitting a traction force to the middle truck apply the force at a theoretical point of attack at a height (h) above the rails so as to have a moment exerted on the middle truck during traction which relieves the load on the leading axle of the middle truck by an amount equal to the relief force on each axle of the leading truck. Likewise, a load is added to the trailing axle of the middle truck equal to the force added to each axle of the trailing truck. This height is defined as $$h = \frac{3a \cdot H}{(5a + 4b)}$$

where a and b are the spacings between the axles and H is the height of the draw hook above the rails.

12 Claims, 6 Drawing Figures

-19-
Z
H
S
32
32'
F
A13
A15
Z13
Z14
Z15
h
1
2
3
4
5
6
7
8
9
10
11
12
13
14
15
17
25a
25b
31
61
62
63
64
65
65a
66
66a

-19-
Z
H
S
32
32'
A13
A15
Z13
Z14
Z15
h
1
2
3
4
5
6
7
8
9
10
11
12
13
15
16
18
20
20'
21
22
23
24
26
27
28
45
46
47
48
49
63
64
65
65a
66
66a

RAILWAY LOCOMOTIVE

This is a continuation, of application Ser. No. 964,379 filed Nov. 28, 1978 now abandoned.

This invention relates to a track propulsion vehicle. More particularly, this invention relates to an electric locomotive having three trucks with motor driven axles.

Heretofore, track propulsion vehicles have been known in which a vehicle body is supported on a rail surface via three trucks, or undercarriages, each of which mounts a pair of motor driven axles. Generally, each motor is connected to an individual axle and transmission means are provided to transmit a traction force to the body. The body, in turn, usually has a drawhook for transmitting the total traction force. In this type of vehicle, the body is usually undivided in the longitudinal direction and is supported in a statically undefined manner. As a result, an irregular distribution of the axle pressures generally occurs which is dependent on the traction force if exerted, as well as on the dimensions and the spring characteristics of the vehicle.

In order to obtain a maximum traction force of the vehicle, it has been known to equalize the load relief of a larger number of front driving axles, e.g., of the driving axles of the front and the middle truck, by using various beam structures, load-distributing intermediate frames or controlled springs.

For the same purpose, it has also been proposed to construct the springs of the middle truck with a spring characteristic which deviates from the springs of the outer trucks in such a manner that the relief of the axles of the two leading trucks relative to the direction of travel are equal among them. The sum of these reliefs is taken up by a uniformly greater load on the axles of the trailing truck. Thus, each trailing axle is then subjected for instance, in the case of a vehicle with three two-axle trucks, to an additional load which is twice as large as the relief of each of the leading axles.

Accordingly, it is an object of this invention to equalize the axle pressures in a track propulsion vehicle in such a manner that, through a uniform distribution of the load reliefs and additional loads produced when a traction force is exerted on always the same number of driving axles, the difference between the loading forces of the leading and the trailing axles is reduced.

It is another object of the invention to provide a track propulsion vehicle wherein the power of the drive motors can be adapted to actual axle loads.

Briefly, the invention provides a track propulsion vehicle which comprises a vehicle body with a drawhook for transmitting a total traction force, three trucks for supporting the body and having a pair of driving axles thereon, and a plurality of motors each of which is drivingly connected to a respective axle. The motors are disposed in two parallel electrically connected groups with one group comprising the motors of the three successive axles leading in the direction of travel and the other group comprising the motors of the three successive trailing axles. In addition, the vehicle has means connecting each truck to the body for traction transmitting a traction force therebetween. The transmission means of the two outer trucks are constructed to equalize the load on the driving axles thereof while the traction transmitting means of the middle truck is constructed to define a theoretical point of attack for a traction force thereat at a predetermined height above a plane coincident with a rail upper surface. This height corresponds to a predetermined moment produced in the transmission of the latter traction force which moment relieves the load on the leading axle of the middle truck with a force corresponding to a relief force exerted on each axle of the leading truck when the total traction force is applied at the draw hook while increasing the load on the trailing axle of the middle truck with a force corresponding to an added force exerted on each axle of the trailing truck when the total traction force is applied at the draw hook.

The leading axles of the vehicle are thus subjected to a relief which is uniform among them, while the same number of trailing axles is subjected to a corresponding additional load which is uniform among them.

In one embodiment, which is suitable for almost all operating conditions and which ensures, particularly in conjunction with trucks without kingpins, secure transmission of the traction forces and the desired equalization of the axle pressures, the traction transmitting means of at least the two outer trucks can each contain a mechanical, hydraulic or pneumatic linkage.

In a further embodiment, an optimal construction and mutual matching of the traction transmitting means of the three trucks in accordance with the prevailing operating conditions can be achieved if the traction transmitting means, at least of the middle truck, comprises an upright kingpin.

In another embodiment, which is distinguished by particular simplicity, the linkages of the two outer trucks can be low-slung traction devices.

In order to assure the desired equalization of the axle pressures for other vehicle constructions as well, the two outer trucks can each be provided with a means for exerting an equalization force which counteracts the load relief of the respective leading axle.

These and other objects and advantages of the invention will become more apparent from the following detailed description and appended claims taken in conjunction with the accompanying drawings in which:

Figure 1:
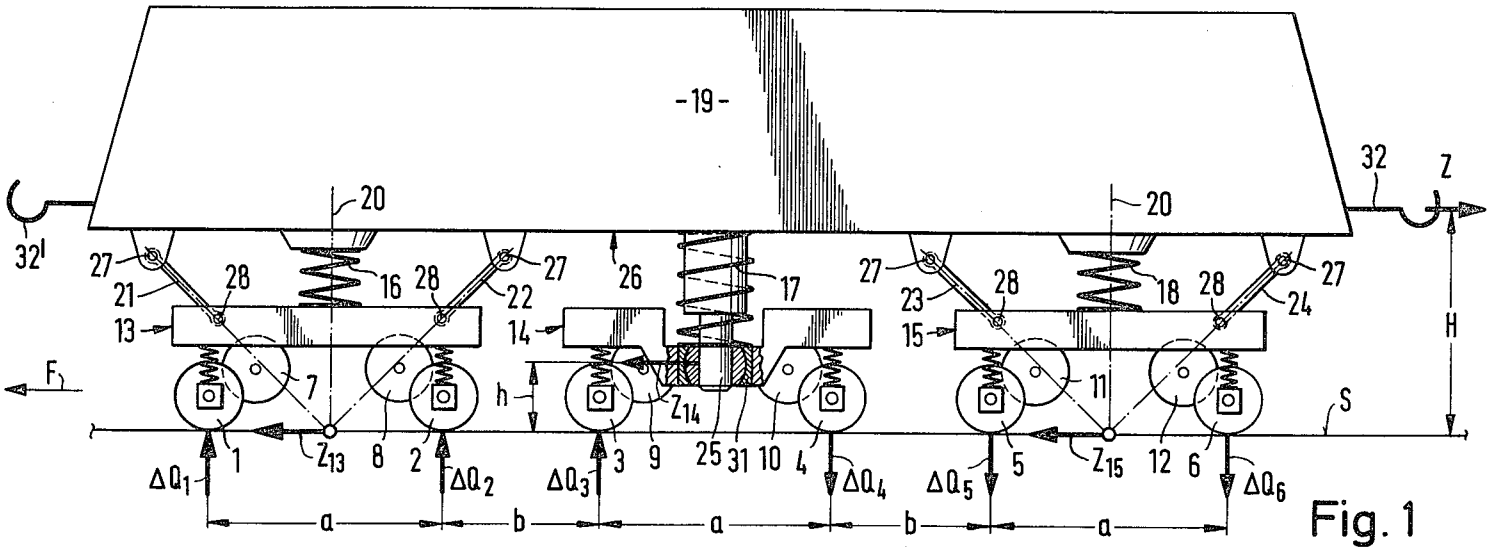
FIG. 1 illustrates a schematic side view of a locomotive with three trucks, with dimensions and forces entered for demonstrating the load relief and additional loads of the driving axles, in accordance with the invention.

Referring to FIG. 1, the track propulsion vehicle, e.g. a locomotive, has six driving axles 1, 2, 3, 4, 5, 6, each of which is drivingly connected to one of six electric motors 7, 8, 9, 10, 11, 12 and has suitable wheels thereon. The motors 7-12 are arranged in pairs in three trucks 13, 14, 15, the frames of which are spring-supported on their driving axles 1 and 2; 3 and 4; 5 and 6; respectively.

The truck frames serve to support a vehicle body 19 via springs 16, 17, 18, which are constructed so that, when load without an active traction force, each of the trucks 13, 14, 15 or each of the driving axles 1, 2, 3, 4, 5, 6, respectively, take up substantially the same share of the load.

In order to transmit the traction and braking forces, the two outer trucks 13 and 15 are connected to the vehicle body 19 via respective means in the form of low-slung traction devices. Each traction device includes pairs of tie rods 21, 22, and 23, 24 which are inclined in pairs relative to the transverse center plane 20 of the corresponding truck. Each tie rod 21–24 is universally connected at each end to a respective one of a frame 26 of the vehicle body 19 and the frame of a truck 13, 15 about a pivot axle 27, 28, respectively. The middle truck 14 is rotatably linked to a vertical kingpin 25 fixedly secured to the vehicle body 19.

The kingpin 25 is supported at the frame of the truck 14 in a transversely movable bearing 31 so that the kingpin 25 can move vertically and swivel about a transverse axis in a universal manner.

As shown, a draw hook 32, 33 is fastened at both ends of the vehicle frame 26 at a distance H above a plane coincident with the upper surface of the rails S.

With a travel direction assumed as per the arrow F, traction forces $Z_{13}$ and $Z_{15}$ are transmitted from the trucks 13 and 15 via the tie rods 22 and 24 to the vehicle frame 26, and a traction force $Z_{14}$ is transmitted from the truck 14 via the kingpin 25. The draw hook 32 therefore transmits a total force $Z_{tot}=Z_{13}+Z_{14}+Z_{15}$.

For travel in the opposite direction, corresponding opposite traction forces are transmitted via the tie rods 21 and 23 and the kingpin 25 as well as via the draw hook 32'.

Figure 2:
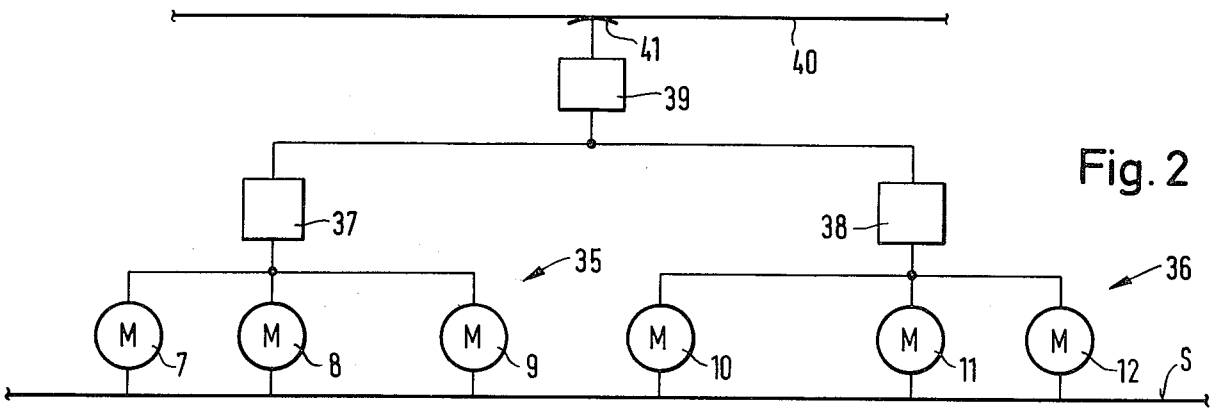
FIG. 2 illustrates a simplified schematic of the motor circuit of the locomotive according to FIG. 1.

According to FIG. 2, the motors 7, 8, 9 of the axles 1, 2, 3 which are leading in the travel direction F, and the motors 10, 11, 12 of the trailing axles 4, 5, 6 are combined in two parallel-connected groups 35, 36, which are connected via respective thyristor control blocks 37 and 39 to a transformer 39. The transformer 39 is connected in a known manner to an overhead wire 40 via a pantograph 41. Current is conducted from the motors 7–12 in known manner via the wheels and the rails S.

The tie rods 21, 22 and 23, 24 are inclined in a known manner that the extensions of their axes intersect in the area of the transverse center plane 20 at the height of the upper surface of the rails S, where the theoretical transmission points of the traction forces $Z_{13}$ and $Z_{15}$ are thus located.

When the total traction force $Z_{tot}$ is exerted, the axles 1, 2 of the leading truck 13 (relative to the direction of travel F) are each relieved by a force $\Delta Q_1$ and $\Delta Q_2$, respectively, while the axles 5, 6 of the trailing truck 15 are additionally loaded by a force $\Delta Q_5$ and $\Delta Q_6$. There prevails $\Delta Q_1=\Delta Q_2$ and $\Delta Q_5=\Delta Q_6$.

The installed height h of the bearing 31 in the middle truck 14 is chosen so that traction force $Z_{14}$ is applied at a height h above the rails S such that the tilting moment produced at the middle truck 14, which is caused by the traction forces acting at the resting point of the wheels and by the counter force to the traction force $Z_{14}$ acting at the bearing 31, relieves the lead axle 3 with a force $\Delta Q_3=\Delta Q_2$ and additionally loads the trailing axle 4 with a force $\Delta Q_4=\Delta Q_5$. The three leading axles 1, 2, 3 are therefore each relieved by an amount which corresponds to the additional loading of each of the three trailing axles 4, 5, 6. For the driving axles 1, 2, 3, 4, 5, 6, which are arranged at spacings a and b according to FIG. 1, a summation of forces results in the following relationships:

$$Z_{tot}\cdot H=2\Delta Q[a/2+(b+a/2)+(b+3a/2)],$$

whence $$\Delta Q=(Z_{tot}\cdot H)/(5a+4b).$$

The height h of the point of application of the traction force $Z_{14}$ is obtained from the relation:

$$h\cdot Z_{tot}/3=\Delta Q\cdot a,$$

and therefrom:

$$h=(3a\cdot H)/(5a+4b).$$

For a vehicle with axle pressures of, for instance, 30 tons and a maximum total traction force $Z_{tot}=72$ tons, and with corresponding dimensions, determined for instance, by design considerations, of, say, H=0.85 meters (m), a=3.2 meters (m) and b=3.65 meters (m), advantageously small axle pressure changes of $\Delta Q=2$ tons can be obtained. The height h is calculated as 0.27 meters (m).

By use of the thyristor control blocks 37 and 38, the current supply to the motors 7, 8, 9 and 10, 11, 12 is influenced according to the axle pressures (reduced by the relief forces $\Delta Q_1$, $\Delta Q_2$, $\Delta Q_3$, of the axles 1, 2, 3 and increased by the forces $\Delta Q_4$, $\Delta Q_5$, $\Delta Q_6$, of the axles 4, 5, 6) in such a manner that the two groups of motors 35 and 36 deliver different power in the prevailing travel direction. This power is proportional to the actual axle loads, so that the same adhesion coefficient $k=Z/Q_{eff}$ is utilized at all axles where Z is the traction force to be transmitted via the respective axle and $Q_{eff}$ is the effective axle load occurring at the respective axle.

Figure 3:
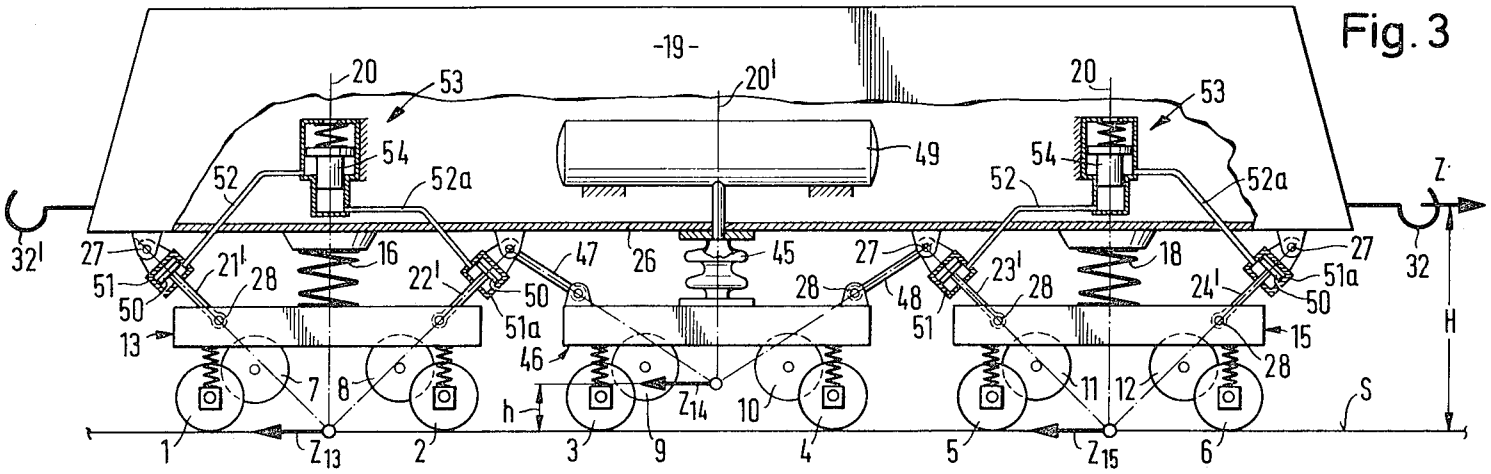
FIG. 3 illustrates a view similar to FIG. 1 of a modified vehicle utilizing a pneumatic traction transmitting means for the middle truck in accordance with the invention.

Referring to FIG. 3, wherein like reference characters indicate like parts as above, the vehicle body 19 may alternatively be supported in the middle via two pneumatic (air) springs 45 on a truck 46 without a kingpin. In addition, the middle truck 46 is flexibly connected to the vehicle body 19 by two inclined tie rods 47 and 48 for transmission of the traction and braking forces. The air springs 45 are connected to a compressed-air tank 49, by which the air springs 45 are held under a pressure such that the middle truck 46 takes the same share of the load as the two outer trucks 13, 15.

Each of the tie rods 21', 22' and 23', 24', respectively, linked to the trucks 13, 15 is provided with a piston 50 which is movably guided in a hydraulic cylinder 51 and **51*a*, respectively, linked to the vehicle body 19. The cylinders 51, 51*a* of each truck 13, 15 are, in turn, connected via pressure lines 52, 52*a* to two cylinder spaces of a piston-cylinder unit 53 arranged at the vehicle body 19. These cylinder spaces are sparated by a spring-loaded differential piston 54 with piston areas of equal size. The units 53 pretension the tie rods 21', 22' and 23', 24' in a manner known per se so that the total of the traction forces to be transmitted by each truck 13, 15, or their vertical components acting on the vertical secondary springs 16, 18 remains constant regardless of the prevailing travel direction. In the case of the middle truck 46, as also with the mechanical linkages of the other embodiments according to FIGS. 1, 4 and 6**, the load relief of the respective leading tie rods is obtained by the correspondingly resilient support, not further shown, in the joints.

The tie rods 47, 48 are arranged so that the intersection of their extended axes and therefore, the theoretical transmission point of the traction force $Z_{14}$ is located at the height h above the upper surface of the rails S. Thus, the prdetermined force couple is exerted in the manner described above on the driving axles 3, 4, and corresponds to the forces $\Delta Q_3$ and $\Delta Q_4$ in FIG. 1.

Figure 4:
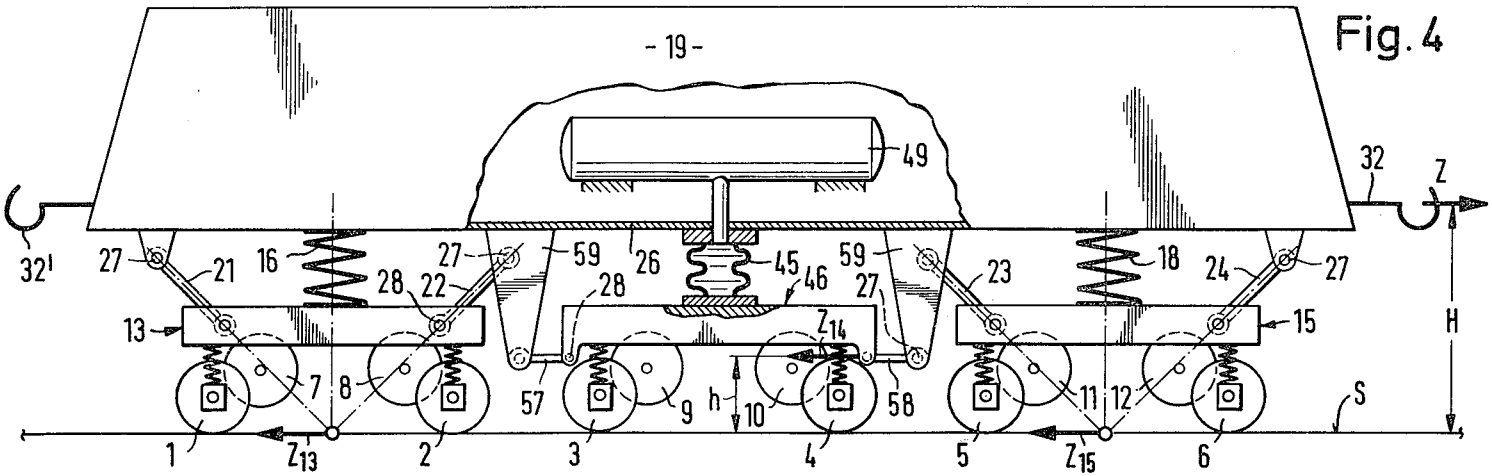
FIG. 4 illustrates a view similar to FIG. 1 of a modified vehicle without kingpins in the traction transmitting means in accordance with the invention.

Referring to FIG. 4, the middle truck 46 may also be connected to the vehicle body 19 by horizontal lengthwise steering rods 57, 58 for transmitting the traction forces $Z_{14}$. In this case, each rod 57, 58 is linked to a bracket 59 of the vehicle body 19. Also, the height position h of the linkage points of the longitudinal steering rods 57, 58 is chosen in accordance with the predetermined force couple to be exerted on the driving axles 3, 4 of the middle truck 46.

Figure 5:
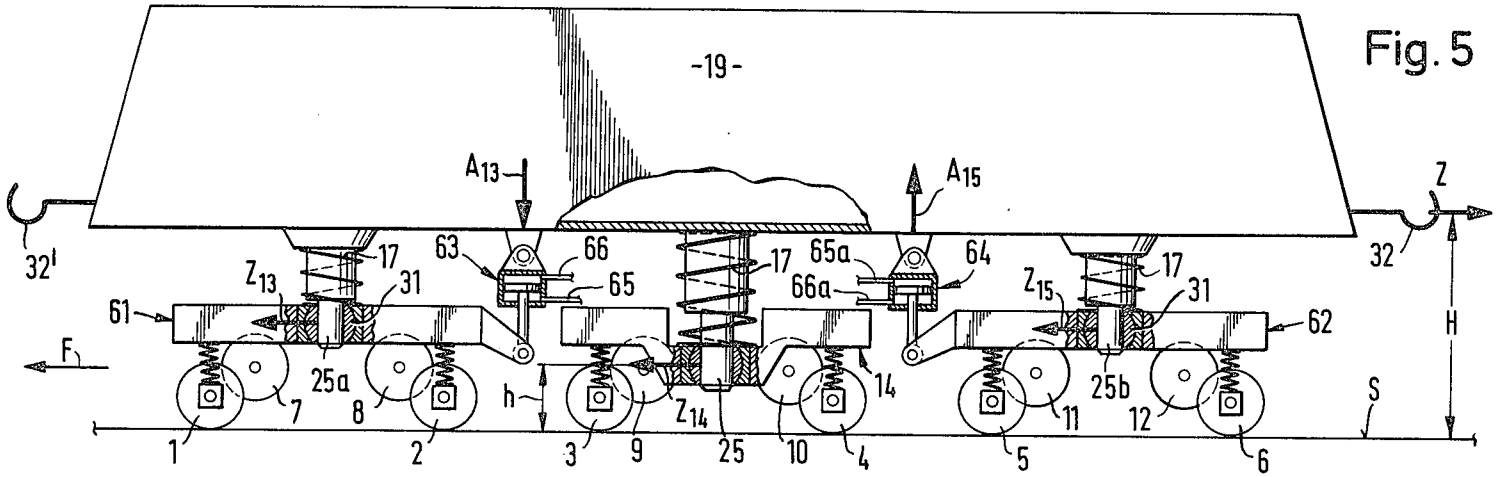
FIG. 5 illustrates a view similar to FIG. 1 of a modified vehicle using kingpins in each traction transmitting means in accordance with the invention.

Referring to FIG. 5, the two outer trucks 61, 62 as well as the middle truck 14, can be linked to the vehicle body 19 at kingpins 25*a* and 25*b*, respectively. Accordingly, the traction forces $Z_{13}$ and $Z_{15}$ are transmitted at the height of the truck frames. In order to equalize the moments and the correspondingly different loads of the driving axles 1, 2 and and 5, 6, the ends of the trucks 61 and 62 facing each other are equipped with means for exerting an equalization force. This means, as shown, are in the form of hydraulic piston-cylinder units 63, 64. The cylinder spaces of the two units 63, 64 serve to introduce an equalization moment counteracting the load-relief moments into the two truck ends in a manner known per se. This equalization moment is formed, with the travel direction assumed in FIG. 5 as per the arrow F, by the counter forces to a force couple $A_{13}$ and $A_{15}$, as shown, which acts on the vehicle body 19.

Figure 6:
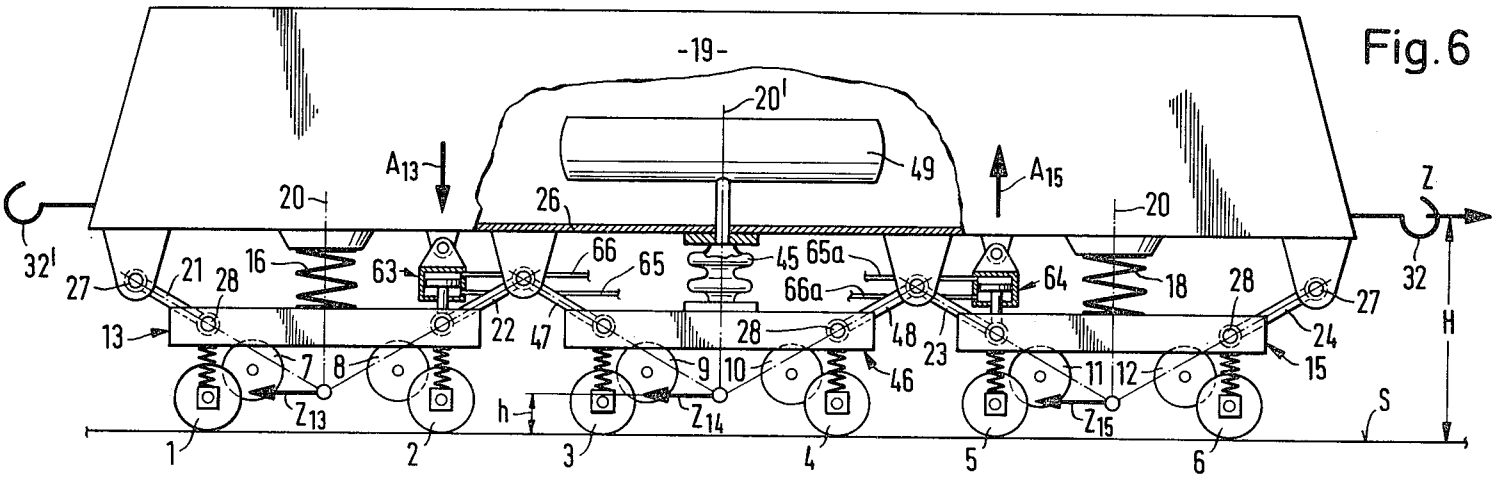
FIG. 6 illustrates a view similar to FIG. 1 of a modified vehicle having means for exerting an equalization force to counteract the load relief of a leading axle in accordance with the invention.

Referring to FIG. 6, corresponding piston-cylinder units 63 and 64 can also be used in a locomotive which does not use any kingpins in the transmission means between the trucks 13, 14, 15 and the vehicle body 19 and where, for instance, for design reasons, the intersections of the extended axes of the tie rods 21, 22 and 23, 24 and therefore, the theoretical transmission points of the traction forces $Z_{13}$ and $Z_{15}$ cannot be placed at the height of the upper surface of the rails S.

Still several other embodiments are possible. Thus, a pneumatic linkage or any combination of appropriate linkages can also be used, for instance, for transmitting the traction forces instead of a hydraulic linkage (FIG. 3).

What is claimed is:

1. A track propulsion vehicle comprising a vehicle body having a drawhook for transmitting a total traction force;

three trucks supporting said body thereon, each said truck having a pair of driving axles mounted therein;

a plurality of motors, each said motor being drivingly connected to a respective axle, said motors being disposed in two parallel electrically connected groups with one group comprising the motors of the three successive axles leading in a direction of travel and the other group comprising the motors of the three successive trailing axles, each said motor group being operable to deliver different power from the other motor group to said respective axles; and means connecting each respective truck to said body for transmitting a traction force therebetween, said means of the two outer trucks equalizing the load on said driving axles thereof and said connecting means of the middle truck defining a theoretical point of attack for a traction force thereat at a predetermined height above a rail upper surface, said height corresponding to a predetermined moment produced in the transmission of said latter traction force, said moment relieving the load on the leading axle of said middle truck and increasing the load on the trailing axle of said middle truck.

2. A track propulsion vehicle as set forth in claim 1 wherein said means of said middle truck includes a vertical kingpin.

3. A track propulsion vehicle as set forth in claim 1 which further comprises a means for exerting an equalization force to counteract said load relief of said leading axles of each of said two outer trucks.

4. A track propulsion vehicle as set forth in claim 1 wherein said means of at least said two outer trucks each contain one of a mechanical, hydraulic and pneumatic linkage.

5. A track propulsion vehicle as set forth in claim 4 wherein each said linkage is a low-slung traction device.

6. A track propulsion vehicle comprising a vehicle body having a drawhook at a given height above a plane coincident with a rail upper surface for transmitting a total traction force;

three trucks supporting said body thereon, each said truck having a pair of driving axles mounted therein, said axles of each said pair of axles being spaced a first distance apart from each other and said pairs of axles being spaced a second distance from an adjacent pair of axles;

a plurality of motors, each said motor being drivingly connected to a respective axle, said motors being disposed in two parallel electrically connected groups with one group comprising the motors of the three successive axles leading in a direction of travel and the other group comprising the motors of the three successive trailing axles, each said motor group being operable to deliver different power from the other motor group to said respective axles; and means connecting each respective truck to said body for transmitting a traction force therebetween, said means of the two outer trucks equalizing the load on said driving axles thereof and said connecting means of the middle truck defining a theoretical point of attack for a traction force thereat at a predetermined height above said plane, said height corresponding to a predetermined moment produced in the transmission of said latter traction force, said moment relieving the load on the leading axle of said middle truck and increasing the load on the trailing axle of said middle truck.

7. A track propulsion vehicle as set forth in claim 6 wherein said means of each truck includes a vertical kingpin secured to said body and universally secured to said respective truck, and which further comprises means for exerting an equalization force to counteract said load relief of said leading axles of each of said two outer trucks.

8. A track propulsion vehicle as set forth in claim 6 wherein said means of said two outer trucks each include a pair of tie rods defining a low-slung traction device, each said tie rod being universally connected at each end to a respective one of said body and a respective truck.

9. A track propulsion vehicle as set forth in claim 8 wherein said means of said middle truck includes a vertical kingpin universally disposed in said middle truck for relative vertical movement thereto and fixedly secured to said body.

10. A track propulsion vehicle as set forth in claim 8 wherein said means of said middle truck includes a pneumatic spring connected between said middle truck and said body.

11. A track propulsion vehicle as set forth in claim 8 wherein each tie rod includes a hydraulic piston and cylinder therein and which further comprises a piston and cylinder unit connected to said cylinders of each respective outer truck to pretension said tie rods thereof.

12. A track propulsion vehicle as set forth in claim 8 which further comprises means for exerting an equalization force to counteract said load relief of said leading axles of each of said two outer trucks.

* * * * *

UNITED STATES PATENT AND TRADEMARK OFFICE

CERTIFICATE OF CORRECTION

PATENT NO. : 4,337,706

DATED : July 6, 1982

INVENTOR(S) : Hugo Loosli

It is certified that error appears in the above—identified patent and that said Letters Patent is hereby corrected as shown below:

Col. 1, lines 62-63 delete "traction"

line 64, change "transmission" to --traction transmitting--

Col. 3, line 3 change "load" to --loaded--

Signed and Sealed this

*Seventh* Day of *September 1982*

[SEAL]

*Attest:*

GERALD J. MOSSINGHOFF

*Attesting Officer*

*Commissioner of Patents and Trademarks*